United States Patent [19]

White

[11] Patent Number: 4,572,589

[45] Date of Patent: Feb. 25, 1986

[54] JOURNAL BEARING

[75] Inventor: Kenneth M. White, Calgary, Canada

[73] Assignee: Western Rock Bit Company Limited, Calgary, Canada

[21] Appl. No.: 717,961

[22] Filed: Mar. 29, 1985

[30] Foreign Application Priority Data

Apr. 12, 1984 [CA] Canada ..... 451864

[51] Int. Cl.[4] ..... F16C 29/12

[52] U.S. Cl. ..... 308/4 R; 308/4 A; 308/6 R; 308/6 A; 384/126; 384/271

[58] Field of Search ..... 308/4 R, 4 A, 6 A, 6 R; 384/126, 271, 513, 453, 452

[56] References Cited

U.S. PATENT DOCUMENTS

| | | | |
|---|---|---|---|
| 466,438 | 1/1892 | Simonds | 384/453 |
| 466,445 | 1/1892 | Simonds | 384/453 |
| 4,372,622 | 2/1983 | Cheek | 308/4 A |
| 4,480,843 | 11/1984 | Springer | 308/4 A |

*Primary Examiner*—Lenard A. Footland

*Attorney, Agent, or Firm*—Russel S. Smart; James McGraw; Martin P. Hoffman

[57] ABSTRACT

The invention relates to a guide bushing used to maintain alignment of a rotary shaft and in particular to a guide bushing for use as a mining deck bushing. When drilling blast holes in surface mining operations, it is conventional to pass the drill pipe through a deck bushing located on the floor or deck of the blast hole drill. During drilling operations the drill pipe has a tendency to run off laterally, and vibrate vertically. The purpose of the deck bushing is to keep the drill pipe as straight as possible, and prevent wear of the more costly deck. The present invention provides a guide bushing for use as a deck bushing and is equipped with a rotatable inner sleeve which is supported by angular journal bearing surfaces and ball bearings located in elongate annular grooves, which allow the guide bushing to maintain alignment of the drill pipe without premature failure of the ball bearings, grooves or other bearing surfaces.

10 Claims, 6 Drawing Figures

JOURNAL BEARING

BACKGROUND OF THE INVENTION

1. Field of the Invention

The invention relates to a guide bushing used to maintain alignment of a rotary shaft and in particular to a guide bushing for use as a deck bushing in a mining blast hole drill.

2. Description of the Prior Art

In surface mining operations, there is a requirement to use rotary drills for drilling blast holes. A drilling arrangement for this purpose usually is in the form of a self-propelled unit having a mast or tower, and power means for rotating a drill pipe and feeding it into the ground. The drill pipe has a suitable rotary cutting bit on its lower end, such as a tri-cone rotary bit.

In a standard arrangement, the drill pipe extends downwardly from a top drive unit and through a deck bushing located on the deck of the drill and then into the ground. The purpose of the bushing is to prevent wear of the deck and keep the drill pipe as straight as possible. There is sufficient clearance between the outside diameter of the drill pipe and the inside diameter of the deck bushing such that the drill pipe and bushing are normally not in contact. When the drill pipe starts to run off laterally, as it frequently does during rock drilling operations, it comes into contact with the bushing.

Prior art bushings consisted of a steel sleeve that was prevented from rotating by lock lugs on the deck of the drilling machine. When the drill pipe came into contact with this type of bushing, rapid wear of both the drill pipe and bushing occurred, because of the radial stress present. Canadian Pat. No. 963,889 issued on May 4, 1975 to Donald Maclean, describes a guide or deck bushing that partially overcomes the short service life problem of the fixed sleeve bushing. This guide bushing includes a rotatable inner sleeve supported by one or more rows of ball bearings. By providing a rotatable inner sleeve in the deck bushing the service life of the bushing is increased substantially. Unfortunately, deck bushings of the Maclean type suffer from premature bearing wear. The problem occurs because during a drilling operation, when the drill pipe comes into contact with the deck bushing, there is not only a force in the radial direction, but there is also a substantial friction force in the axial direction between the drill pipe and the inside diameter of the inner sleeve, due to axial vibration of the drill pipe. Consequently, since the inner sleeve is supported by the ball bearings and prevented from moving in an axial direction, very high contact stresses are generated between the ball bearings and the grooves they are located in, which leads to premature bearing failure.

SUMMARY OF THE INVENTION

The present invention overcomes this problem of premature bearing failure and still provides sufficient radial support by providing a journal bearing that has a rotatable inner sleeve and an outer housing with complementary bearing surfaces. An annular row of ball bearings is provided in special elongate grooves. In addition, axial clearance is provided between the bearing surfaces of the inner sleeve and outer housing such that a substantial axial movement relative to the radial movement of the inner sleeve is allowed.

More particularly, according to the present invention there is provided a guide bushing for maintaining alignment of a rotary shaft comprising an outer housing adapted to be carried by a support, an axial borehole extending therethrough and defining at least two bearing surfaces, one of said bearing surfaces being an inner annular bearing surface, the other being an angled bearing surface located below the inner annular bearing surface and angled such that at a point proximal to the inner annular bearing surface the diameter of the borehole is greater than at a point remote from the inner annular bearing surface; an internal sleeve rotatably contained within the borehole and spaced slightly from the outer housing to form a small annular clearance space therebetween, the sleeve having at least two bearing surfaces, one of said bearing surfaces being an outer annular bearing surface, the other being an angled bearing surface located below the outer annular bearing surface and angled in a manner complementary to the angled bearing surface of the outer housing; opposed annular grooves in the inner annular bearing surface of the housing and the outer annular bearing surface of the sleeve, at least one of the grooves being axially elongate, and ball bearings in the grooves and spanning the annular space and in conjunction with the angled bearing surfaces providing support for the sleeve within the outer housing, the sleeve having a borehole extending therethrough for unimpeded reception of the rotary shaft, whereby when the rotary shaft tends to move laterally and contact the sleeve the coacting angled bearing surfaces and the annular bearing surfaces take the load.

The advantages and other features of the present invention will be more fully described with reference to the accompanying drawings.

DESCRIPTION OF PREFERRED EMBODIMENT

Figure 1:
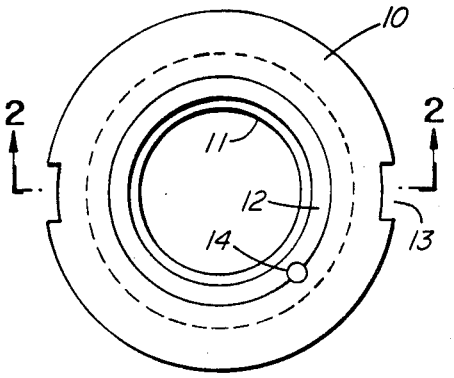
FIG. 1 is a top view of a guide bushing according to the invention in use as a deck bushing.

Reference should first be made to FIG. 1 in which there is shown an outer housing 10, an inner sleeve 11, and an upper thrust ring 12. Cut-out relief 13 is provided in the outer housing 10 for interfitting lugs on the deck of the drilling machine, not shown. A lubrication means 14 is also shown.

Figure 2:
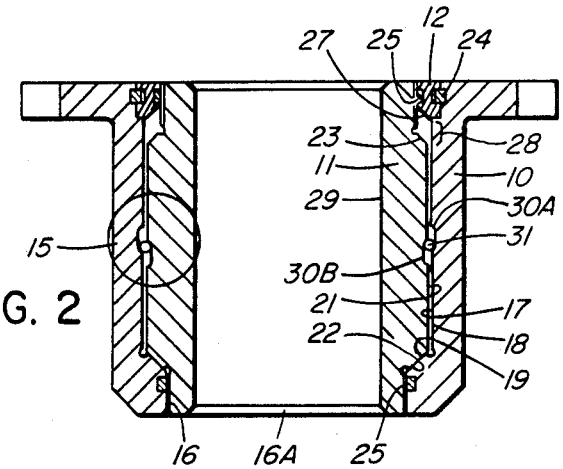
FIG. 2 is an axial section of the guide bushing taken on section line 2—2 of FIG. 1 and showing the bearing in a non-working position.

The cross-sectional view in FIG. 2 shows the outer housing 10, the inner sleeve 11, and the upper thrust ring 12. The outer housing 10 has a borehole 16 extending therethrough and an inner annular journal bearing surface 17. A lower portion 19 of the journal bearing surface is angled relative to the vertical axis. The inner sleeve 11 is rotatably contained within the borehole 16 and spaced slightly from the outer housing 10 to form a small annular clearance space 18 therebetween. The sleeve 11 has an outer annular journal bearing surface 21, with a lower portion 22 angled relative to the vertical axis and an upper portion 23 of the bearing surface 21 is also angled relative to the vertical axis. The inner sleeve 11, has a borehole 16A, extending therethrough, to allow passage of a drill pipe (not shown). Inner sleeve 11 has an inner surface 29 defined by borehole 16A. The upper thrust ring 12 is retained in the outer housing 10 by means of a lock ring 24. An upper bearing surface 27 of the upper thrust ring 12 is angled to the vertical axis. The axial spacing between the angled surface 19 of the outer housing and the angled surface 27 on the upper thrust ring is greater than that between the angled surfaces 22 and 23 of the inner sleeve such that an axial clearance distance designated 28 is provided between the inner sleeve 11 and the upper thrust ring 12. Conventional sealing means 25 in the upper thrust ring 12 and 26 on outer housing 10 are provided to prevent the escape of any lubricants.

Opposed elongate annular grooves 30A and 30B are located in the outer housing 10 and the inner sleeve 11 respectively, and rotatable ball bearings 31 are located in the annular space created between the elongate grooves 30A and 30B.

In FIG. 2, the journal bearing is shown in the non-working position. In this position, the lower annular journal bearing surfaces 19 and 22 are in contact. The surfaces of the ball bearings 31 are also in contact with a portion of each groove 30A and 30B respectively. In this position, the annular journal bearing surfaces 17 and 21 are not in contact, and the axial clearance distance 28 is at a maximum amount.

Figure 3:
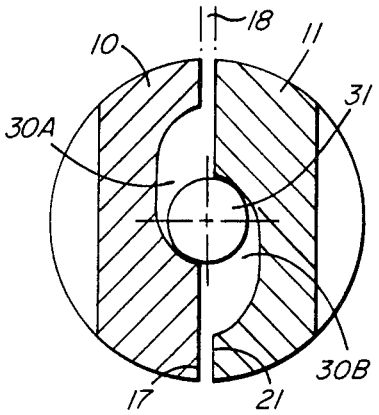
FIG. 3 is an enlarged view of area 15 circled in FIG. 2.

With particular reference to FIG. 3, the annular groove 30A on outer housing 10 and groove 30B on inner sleeve 11 are seen to be symmetrical. In the configuration shown, the vertical height of each groove 30A and 30B is equal to the diameter of one ball bearing 31 plus one half the axial clearance distance 28. The radial depth of each groove increases from each end such that an axial movement of the inner sleeve 11 relative to the outer housing 10 will allow the bearing surfaces 17 and 21 to come into contact. The ends of each groove are curved and over an initial portion shown as angle 33 have a radius of curvature equal to the radius of the ball bearing 31. Angle 33 is approximately forty five degrees. From the forty five degree angle point the radius of curvature of the groove ends gradually increases.

Figure 3A:
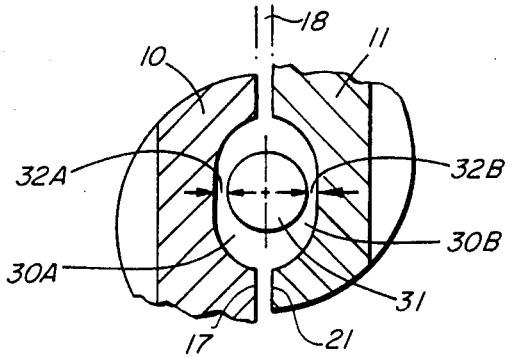
FIG. 3A is a view similar to that of FIG. 3 but showing the disposition of the parts when the grooves are directly opposite each other but with the annular clearance space 18 of FIG. 3 maintained.

FIG. 3A is a view of the annular groove 30A on the outer housing 10 and groove 30B on inner sleeve 11 when they are directly opposite each other. At this position, the distance from the centre of the ball bearing 31 to the groove 30A is equal to the ball bearing radius plus distance 32A. The groove 30A is designed so that at this position, distance 32A is the same as the radial clearance distance 18. Since the grooves 30A and 30B are symmetrical, distance 32B is also the same as the radial clearance distance 18.

In a mining operation, the journal bearing is subjected to two distinct loading conditions. One is of a periodic nature, when a minor irregularity in the rock formation is encountered by the drill bit and the drill pipe is knocked off centre such that the inside diameter 29 of the inner sleeve 11 and the outside diameter of the drill pipe come in contact. In this condition, the loads are relatively minor and the inner sleeve 11 rotates on the ball bearings 31 provided, or the angled journal bearing surface 22 rises slightly and the journal bearing surface 17 resists the load. The second form of loading is much more severe and is encountered when drilling badly faulted formations. When this situation occurs the drill pipe is in hard, continuous contact with the inner sleeve 11 and vibrations from the drill bit are causing axial motion of the drill pipe. The journal bearing surfaces 17 and 21 are in contact and the inner sleeve 11 is rotating and moving axially with the drill pipe. In this position, since the distance from the centre of the ball bearing 31 to each groove 30A and 30B when the grooves are directly opposite each other is the radius of ball bearing 31 plus one annular clearance space 18, and since the grooves are symmetrical, an allowance of one annular clearance distance 18 is made for wear on the journal bearing surfaces 17 and 21, before the ball bearings 31 are subjected to any radial load. Also, as the axial displacement of the inner sleeve 11 approaches the maximum allowed, which is the axial clearance distance 28 in the non-working position, the ball bearings 31 come into contact with each groove 30A and 30B. Since the ball bearings 31 are in contact with the grooves 30A and 30B, the bearings 31 and upper bearing surface 27 tend to recentralize the inner sleeve 11 relative to the outer housing 10. Since the inner sleeve 11 is moving axially in the outer housing 10, grease lubricant is continually being forced from the upper to lower axial clearance space formed, and by recentralizing the inner sleeve 11 each time it has travelled the maximum axial distance the journal bearing surfaces 17 and 21 are continuously lubricated. Suitable seals are provided to retain the lubricant and prevent entry of contaminates into the annular clearance space 18.

Figure 4:
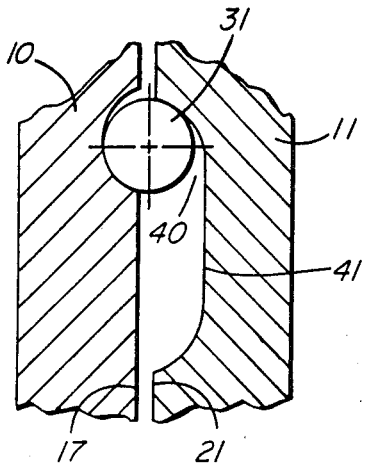
FIG. 4 is an enlarged view of an alternate configuration of area 15 circled in FIG. 2.

FIG. 4 shows a possible alternate configuration of area 15 circled in FIG. 2. This configuration is desirable when the axial clearance required exceeds twice the diameter of the ball bearings 31. Radial clearance for the ball bearings 31 is provided as indicated at 40. Groove 41 on inner sleeve 11 has a height of one ball bearing diameter plus the desired axial travel distance. The radial depth of the groove 41 is sized to allow for clearance between the ball bearings 31 and the groove 41 as well as to allow for radial wear of the journal bearing surfaces 17 and 21.

Figure 5:
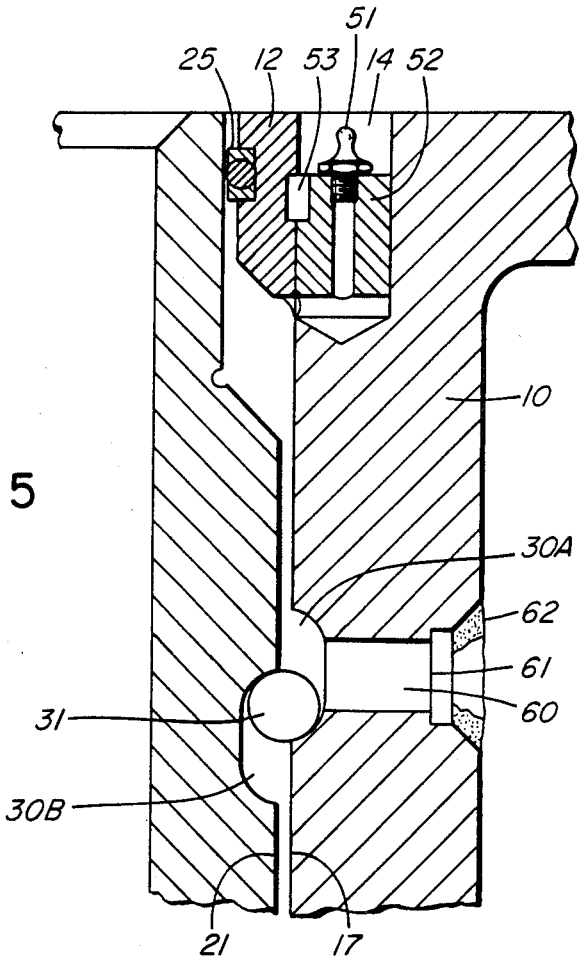
FIG. 5 is a section showing lubrication means of the bushing, and illustrating a technique for placing the ball bearings in the grooves.

FIG. 5 is a section showing the lubrication means 14 in FIG. 1 and illustrates a technique for placing ball bearings 31 in the grooves 30A and 30B. A lubrication fitting 51 is threaded into a separate hollow dowel pin 52. The dowel pin 52 is prevented from being accidentally removed by a key 53 which cooperates with the thrust ring 12. By locating the dowel pin 52 at the interface of the upper thrust ring 12 and outer housing 10, upper thrust ring 12 is prevented from rotating in outer housing 10. Conventional sealing means 25 retain the lubricant and prevent entry of contaminants into the annular clearance space 18. Since the inner sleeve 11 is moving axially in the outer housing 10, the grease lubricant is continually being forced from the upper to lower axial clearance space formed, which ensures that the annular journal bearing surfaces 17 and 21 are continuously lubricated.

Ball bearing insertion hole 60 is shown as having a ball plug 61 installed and welded at 62 in the outer housing 11. This is a conventional method of inserting the ball bearings 31 in the grooves 30A and 30B.

Various modifications can be made in the invention as hereinabove described. For example, instead of forming the elongate groove 41 in the inner sleeve 11 (as shown in FIG. 4), the elongate groove 41 could be formed in the outer housing 10.

Also, the particular use for the guide bushing described was as a mining deck bushing, however it is envisaged that it may be used for any purpose where alignment of a rotary shaft must be maintained.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed as my invention is:

1. A guide bushing for maintaining alignment of a rotary shaft comprising an outer housing adapted to be carried by a support, an axial borehole extending therethrough and defining at least two bearing surfaces, one of said bearing surfaces being an inner annular bearing surface, the other being an angled bearing surface located below the inner annular bearing surface and angled such that at a point proximal to the inner annular bearing surface the diameter of the borehole is greater than at a point remote from the inner annular bearing surface; an internal sleeve rotatably contained within the borehole and spaced slightly from the outer housing to form a small annular clearance space therebetween, the sleeve having at least two bearing surfaces, one of said bearing surfaces being an outer annular bearing surface, the other being an angled bearing surface located below the outer annular bearing surface and angled in a manner complementary to the angled bearing surface of the outer housing; opposed annular grooves in the inner annular bearing surface of the housing and the outer annular bearing surface of the sleeve, at least one of the grooves being axially elongate, and ball bearings in the grooves and spanning the annular space and in conjunction with the angled bearing surfaces providing support for the sleeve within the outer housing, the sleeve having a borehole extending therethrough for unimpeded reception of the rotary shaft, whereby when the rotary shaft tends to move laterally and contact the sleeve the coacting angled bearing surfaces and the annular bearing surfaces take the load.

2. A guide bushing as claimed in claim 1 including means to restrict upward vertical displacement of the sleeve.

3. A guide bushing as claimed in claim 2 wherein the means to restrict the vertical displacement of the sleeve comprises an upper thrust ring connected to the outer housing, the thrust ring having a lower surface which cooperates with an upper portion of the sleeve, the spacing between the lower surface of the thrust ring and the angled bearing surface of the outer housing being greater than the spacing between the upper portion of the sleeve and the angled bearing surface of the sleeve, whereby an axial clearance space is formed between the thrust ring and the inner sleeve.

4. A guide bushing as claimed in claim 3 wherein the lower surface of the upper thrust ring is angled relative to a vertical axis and the upper portion of the sleeve has a bearing surface angled to the same degree and in the same direction as the lower surface of the upper thrust ring.

5. A guide bushing as claimed in claim 3 in which the axial length of the or each elongate groove is equal to the ball bearing diameter plus one half the axial clearance space.

6. A guide bushing as claimed in claim 1, in which both of the opposed annular grooves are elongate.

7. A guide bushing as claimed in claim 1, in which both of the opposed annular grooves are elongate and identical in length.

8. A guide bushing as claimed in claim 1, in which only the annular groove in the inner sleeve is elongate.

9. A guide bushing as claimed in claim 1 in which each elongate groove has a radial depth which increases from each end such that on relative axial movement of the sleeve and housing a maximum separation between the grooves is reached, this maximum separation being approximately twice the radial distance of the annular clearance space plus the diameter of the ball bearings.

10. A guide bushing as claimed in claim 9 in which the ends of each groove are curved and over an initial portion have a radius of curvature equal to the radius of the ball bearings, and over the remaining portion have a radius of curvature greater than the radius of the ball bearings.

* * * * *